US005929458A

United States Patent [19]

Nemezawa et al.

[11] Patent Number: 5,929,458

[45] **Date of Patent: *Jul. 27, 1999**

[54] RADIATION SHIELD

[75] Inventors: Isao Nemezawa; Tadahiro Kimura; Tetsu Oomori; Akira Mizuochi, all of Hitachi, Japan

[73] Assignees: Hitachi, Ltd., Tokyo; Hitachi Engineering Services Co., Ltd., Ibarakis, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,562

[22] Filed: Apr. 30, 1997

[30] Foreign Application Priority Data

May 7, 1996 [JP] Japan ..... 8-112282

[51] Int. Cl.[6] ..... G21F 3/02

[52] U.S. Cl. ..... 250/519.1; 250/517.1

[58] Field of Search ..... 250/515.1, 517.1, 250/518.1, 519.1

[56] References Cited

U.S. PATENT DOCUMENTS

| | | | |
|---|---|---|---|
| 3,680,498 | 8/1972 | Roos | 250/517.1 |
| 4,090,087 | 5/1978 | Weissenfluh | 250/519.1 |
| 4,400,623 | 8/1983 | Jacobson | 250/519.1 |
| 4,530,813 | 7/1985 | Jacobson | 250/519.1 |
| 4,608,495 | 8/1986 | Jacobson | 250/519.1 |
| 5,220,175 | 6/1993 | Cole | 250/519.1 |
| 5,483,562 | 1/1996 | Kornfeldt et al. | 250/519.1 |
| 5,859,438 | 1/1999 | Nemezawa et al. | 250/519.1 |

FOREIGN PATENT DOCUMENTS

| | | |
|---|---|---|
| 61-147998 | 9/1986 | Japan . |

*Primary Examiner*—Bruce C. Anderson

*Attorney, Agent, or Firm*—Fay, Sharpe, Beall, Fagan, Minnich & McKee

[57] ABSTRACT

In a radiation shield in which a bag having flexibility is filled with a shielding liquid, a side of the bag is integrally equipped with reinforcement members which have a higher strength than the material of the bag and are longitudinally disposed and spaced horizontally. The bag filled with the shielding liquid is restrained from being deformed (swollen in its lower portion) by the reinforcement members having a higher strength than the material of the bag, so that the radiation shield is maintained in a predetermined thickness and exhibits predetermined performance.

5 Claims, 7 Drawing Sheets

RADIATION SHIELD

BACKGROUND OF THE INVENTION

The present invention relates to a radiation shield which is used for protecting workers from radiation exposure in a radiation environment.

In recent years, working under radiation, inclusive of safety, is generalized in accordance with laws and regulations in the fields of medical treatment, general industry and atomic plants, and satisfactory maintenance and inspection are conducted in various industries. Working in a radiation environment is indispensable to all industrial fields, and required measures are taken to reduce the radiation exposure of workers engaged in such working. As one measure, there is a method which uses a radiation shield such as that proposed in Japanese Utility Model Laid-Open No. 147998/1986. In this method, the attenuation characteristic of radiation which is attenuated by water serving as a shielding liquid is utilized, and equipment or apparatus which may emit radiation is covered with water-filled flexible bags made of synthetic resin cloth or rubber.

However, the radiation shield proposed in Japanese Utility Model Laid-Open No. 147998/1986 has the following practical disadvantages, and functional and practical improvements are needed in practical use.

Specifically, since the conventional radiation shield is used within the strength range of the bag, a reinforcement wall made of the same material as the bag is provided inside the bag, and if a bag is needed which has the thickness and strength required for a shielding effect which matches the size of a radiation source, a bag having a considerably large weight must be prepared. When in use, the bag may be deformed or damaged in spite of the reinforcement wall. It is, therefore, necessary to make structural improvements so as to increase the resistance of the bag to excessively large external forces and the like, and there is also room for improvements in handling, storage and the like.

Accordingly, a first object of the present invention is to provide a radiation shield having a shielding effect which achieves a satisfactory reduction in radiation exposure without causing deformation due to a increase in the weight of a bag due to variations in the weight, the shielding thickness and the like of the bag even if a change occurs in the conditions under which the radiation shield is used, unlike the above-described conventional radiation shield. In addition to the first object, a second object of the present invention is to provide a radiation shield with ease of handling and ease of storage.

SUMMARY OF THE INVENTION

A first embodiment of the invention provides a radiation shield in which a bag having flexibility is filled with a shielding liquid, wherein a side of the bag is integrally equipped with a reinforcement member having a higher strength than the material of the bag. Since the reinforcement member restrains deformation of the shape of the radiation shield, the bag filled with the shielding liquid is restrained from being deformed (swollen in its lower portion) by a reinforcement rod or pipe having a higher strength than the material of the bag, so that the radiation shield maintains a predetermined shielding thickness and exhibits predetermined shielding performance, thereby securely achieving a radiation shielding function.

A second embodiment of the invention provides a radiation shield in which a bag having flexibility is filled with a shielding liquid, wherein a side of the bag is integrally equipped with reinforcement members which have a higher strength than the material of the bag and are longitudinally long, the reinforcement members being intermittently arranged in a horizontal direction at spaced intervals. Since reinforcement rods or pipes restrain deformation of the shape of the radiation shield, the radiation shield can securely achieve a radiation shielding function and is not easily deformed. However, since the reinforcement members are intermittently provided, the bag can be rolled by folding the portions between the reinforcement members or by rolling the reinforcement members in a coil, so that the radiation shield can be folded into a compact shape which is easy to handle or put away.

A third embodiment of the invention provides a radiation shield which further comprises connectors for connecting the reinforcement members to each other in the second embodiment, the connectors being removably attached to the reinforcement members. In addition to the advantages and effects of the second embodiment, since the reinforcement members are connected by the connectors, reinforcement is strengthened and it is possible to obtain the advantage and effect of more securely preventing the radiation shielding function from being lowered by the deformation of the shape of the radiation shield.

A fourth embodiment of the invention provides a radiation shield wherein the connectors are removably attached to the reinforcement members in the third embodiment. In addition to the advantages and effects of the third invention, it is possible to obtain the advantage that the connectors can be removed from the reinforcement members to fold or roll the bag into a compact shape which is easy to handling and put away.

A fifth embodiment of the invention provides a radiation shield wherein the reinforcement members of the second embodiment are provided with wheels. In addition to the advantages and effects of the second embodiment, since the shield can be readily moved owing to the ability of the wheels to roll, the radiation shield can be readily moved, so that the handling thereof is improved.

A sixth embodiment of the invention provides a radiation shield wherein the reinforcement members of the fifth embodiment are linked to each other by an expandable and shrinkable link mechanism. In addition to the advantages and effects of the fifth embodiment, it is possible to obtain an effect which enables the radiation shield to be readily folded or unfolded by the operation of folding or unfolding the bag by expanding or shrinking the link mechanism.

A seventh embodiment provides a radiation shield which comprises a plurality of radiation shields linked together by connectors. The advantages and effects of the third invention can be applied to a wide range of fields.

DESCRIPTION OF PREFERRED EMBODIMENTS

Figure 1:
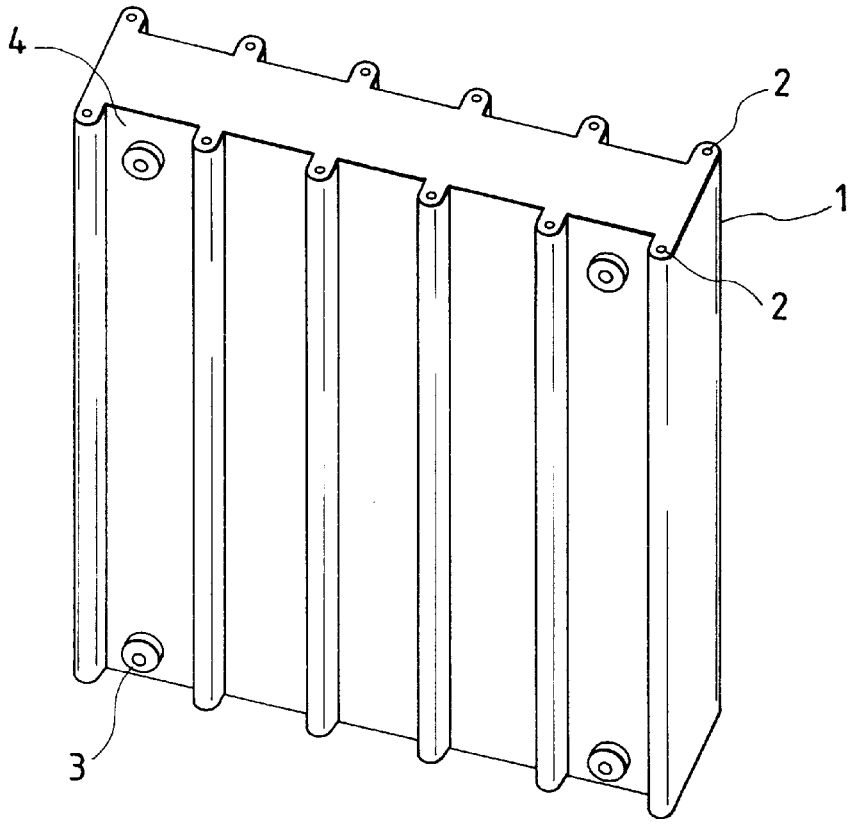
FIG. 1 is a perspective view of a radiation shield according to an embodiment of the present invention.
Figure 2:
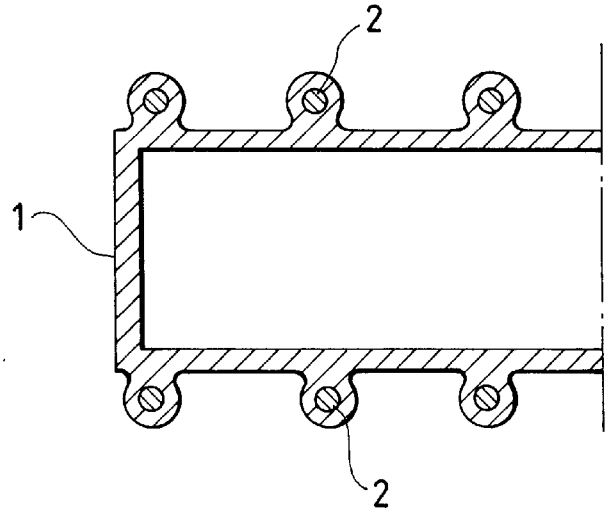
FIG. 2 is a view showing in horizontal section a portion of the radiation shield of FIG. 1 having reinforcement members therein.

A radiation shield 1, which is shown in FIG. 1, includes a flexible bag made from synthetic resin cloth, a rubber plate or their composite material. The radiation shield 1 has a hollow interior, as shown in FIG. 2, and water is injected into the hollow interior as a shielding liquid.

For the purpose of injecting water, lower and upper side portions of the radiation shield 1 are respectively provided with a water injecting port 3 and an exhaust port 4, as shown in FIG. 1.

Either of the water injecting port 3 and the exhaust port 4 can be openably closed with a stopper or the like. A plurality of longitudinal ribs 12, which are made of the same material as the bag of the radiation shield 1, are integrally formed at spaced intervals on outside surfaces of the bag of the radiation shield 1.

A reinforcement pipe 2 is inserted in each of the longitudinal ribs integrally with the bag.

The material of the reinforcement pipe 2, whether metallic or non-metallic, is selected to have a higher bending strength than the bag.

When the radiation shield 1 is to be used, the respective stoppers are removed from the water injecting port 3 and the exhaust port 4.

Then, water is injected through the water injecting port 3 and the internal air is exhausted from the bag through the exhaust port 4, whereby the radiation shield 1 is fitted with water so that the radiation shield 1 has a thickness which can shield radiation.

After that, the water injecting port 3 and the exhaust port 4 are closed with the respective stoppers.

Owing to an increase in the weight of the radiation shield 1 due to the water contained therein, the radiation shield 1 tends to deform so that its lower portion swells and its upper portion becomes too thin to shield radiation. However, since such deformation is prevented by the longitudinal ribs and the strength of the reinforcement pipes 2 of the respective longitudinal ribs, a sufficient thickness for radiation shielding can be maintained over the whole of the radiation shield 1.

After the use of the radiation shield 1, the water injecting port 3 and the exhaust port 4 are opened to discharge the water from the radiation shield 1, and the radiation shield 1 is folded into a compact form by folding the portion between each of the reinforcement pipes 2, or it is rolled for storage without any of the reinforcement pipes 2 being folded or bent.

Accordingly, the radiation shield 1 is easy to handling because of its compactness and can be stored in a small space.

It is more preferable to set the strength of the reinforcement pipes 2 so that no large deformation occurs in the radiation shield 1 even if the water inside the radiation shield 1 is shaken by an external force such as an earthquake.

Figure 3:
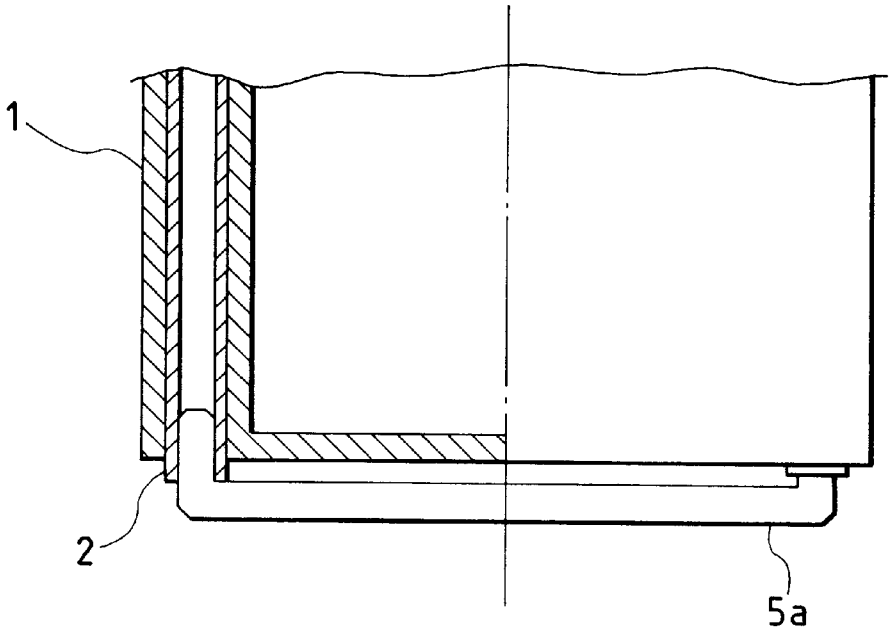
FIG. 3 is a partial-sectional view showing a connector connecting two reinforcement members in the radiation shield of FIG. 1.
Figure 4:
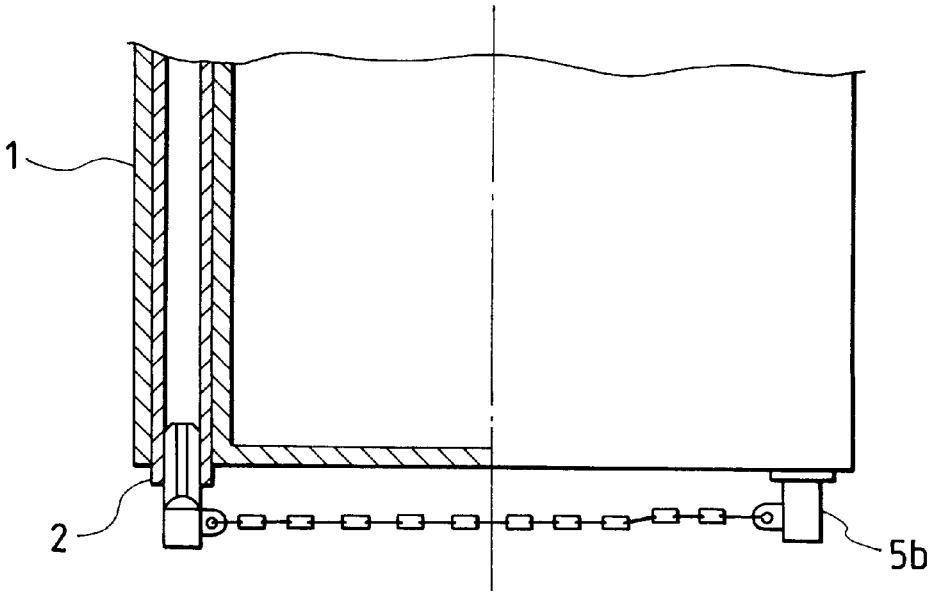
FIG. 4 is a partial-sectional view showing a flexible connector connecting two reinforcement members in the radiation shield of FIG. 3.

Since the reinforcement pipes 2 have lengths extending in their longitudinal directions and are not connected to one another, the radiation shield 1 might fall horizontally. To cope with this problem, as shown in FIG. 3, a plurality of reinforcement pipes 2 may be connected to one another by connectors 5*a* which are bent at their opposite ends, for the purpose of horizontal reinforcement.

Such connection is made by first fitting one bent end of any of the connectors 5*a* into one end of any of the reinforcement pipes 2 and then fitting the other bent end of the connector 5*a* into one end of the reinforcement pipe 2 located in the desired reinforcement direction.

When the radiation shield 1 is to be put away, the radiation shield 1 is rolled or folded with the connectors 5*a* removed from the reinforcement pipes 2.

The connectors 5*a* may be replaced with connectors 5*b* each having an arrangement in which fitting metals to be removably fitted into the reinforcement pipes 2 are connected to each other by a metal chain 5*c*.

Figure 5:
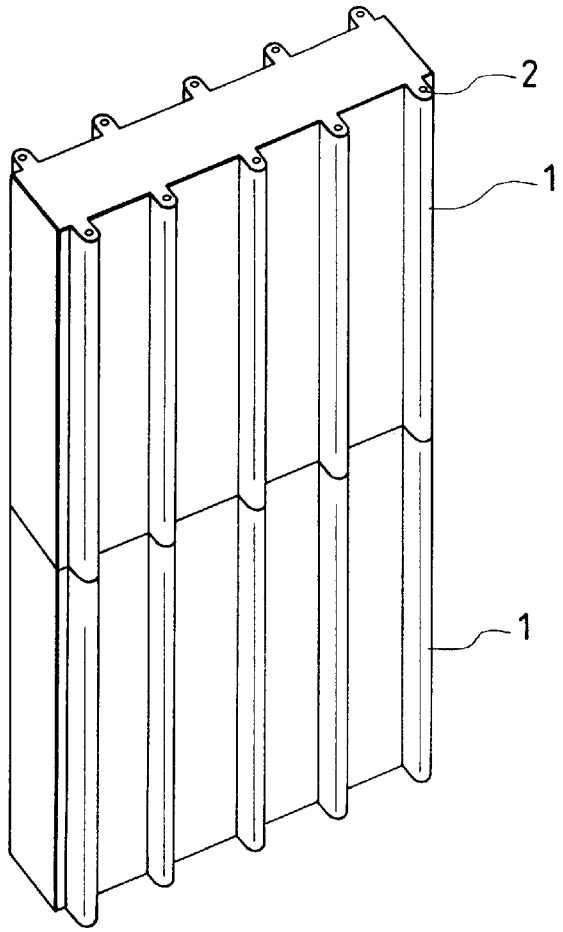
FIG. 5 is a perspective view showing a case where a plurality of radiation shields identical to that shown in FIG. 1 are stacked.

If a longitudinally expanded surface is to be constructed as a radiation protection surface, a plurality of radiation shields 1 into which water is injected may be stacked in the vertical direction, as shown in FIG. 5.

In the stacking of the radiation shields 1, the stacking positions of the radiation shields 1 are adjusted so that the reinforcement pipes 2 are arranged in a line in the vertical direction.

Figure 6:
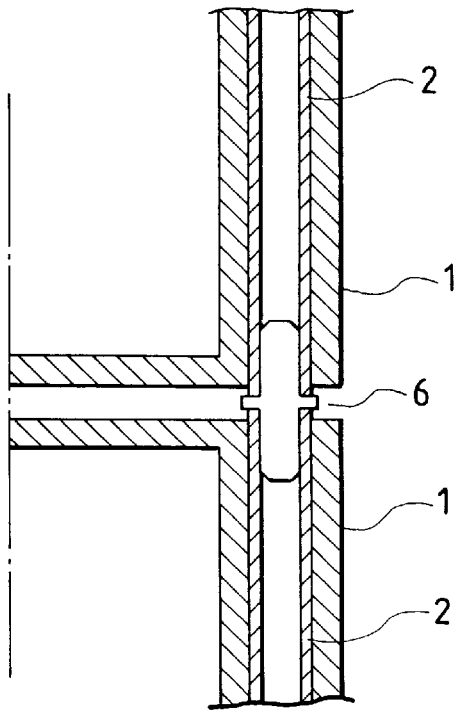
FIG. 6 is a view showing in longitudinal section a connection between two radiation shields which are longitudinally stacked as shown in FIG. 5.

In the stacking of the radiation shields 1, as shown in FIG. 6, connectors 6 each having a flange which is larger in diameter than the reinforcement pipes 2 are fitted at vertical intermediate positions in such a manner that each of the connectors 6 is inserted between adjacent ones of reinforcement pipes 2 stacked in the vertical direction, whereby the reinforcement pipes 2 are linked together in the vertical direction so that the radiation shields 1 located in an upper position do not easily fall or come off.

Figure 7:
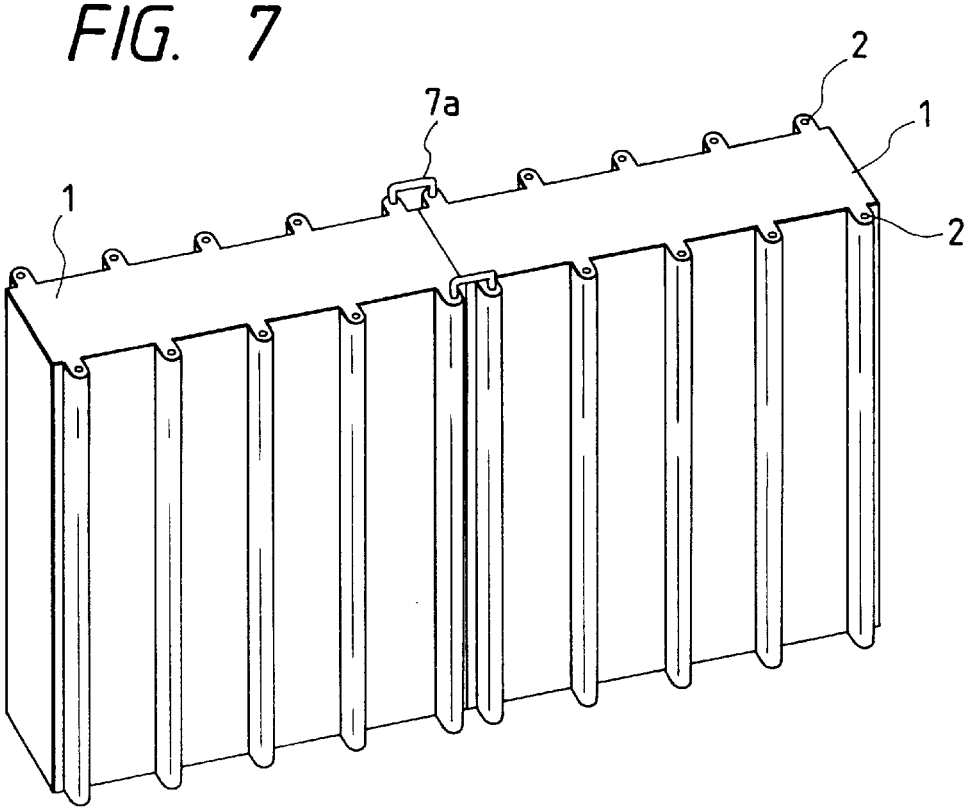
FIG. 7 is a perspective view showing a case where a plurality of radiation shields identical to that shown in FIG. 1 are used in parallel in a horizontal direction.

If a horizontally expanded surface is to be constructed as a radiation protection surface, a plurality of radiation shields 1 into which water is injected are arranged adjacent to one another in the horizontal direction, as shown in FIG. 7.

Each of the radiation shields 1 is connected to the adjacent one at the reinforcement pipes 2 located at respective adjacent sides, by connectors 7*a*.

Figure 8:
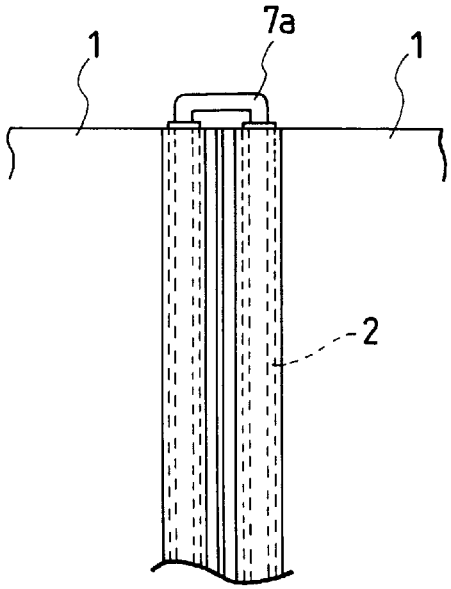
FIG. 8 is an enlarged elevational view of the vicinity of the connection portion of FIG. 7.

Each of the connectors 7*a* is made from a U-shaped bar member. As shown in FIG. 8, one connector 7*a* is fitted at one end into the reinforcement pipe 2 of one of two adjacent radiation shields 1 and at the other end into the reinforcement pipe 2 of the other radiation shield 1, whereby the adjacent radiation shields 1 are connected to each other and the deviation of the relative position between them is restrained so that a gap through which radiation leaks is prevented from easily occurring.

In addition, if a connector 7*b* is employed, the deviation of the relative position is restrained to a further extent, so that the occurrence of a gap through which radiation leaks is more securely prevented.

Figure 9:
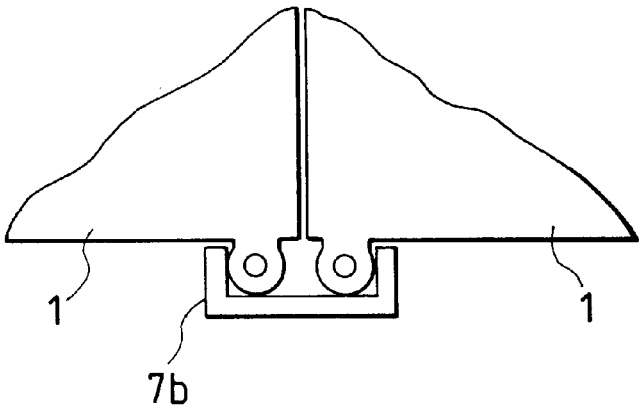
FIG. 9 is top plan view of another connector which can be in the radiation shield of FIG. 7.

As shown in FIG. 9, the connector 7*b* is a member having a U-shaped cross section and clamps the longitudinal-rib of one of two adjacent radiation shields 1 and the longitudinal rib of the other radiation shield 1. The longitudinal ribs are clamped at two or three positions dispersed in the vertical direction.

The connectors 7*b* may be used alone or together with the connectors 7*a*.

In either case, the connectors 7*b* restrain gaps from occurring between adjacent ones of the radiation shields 1.

To make the radiation shield 1 more portable and easier to handle, the structures shown in FIGS. 10 to 13 are adopted.

Figure 10:
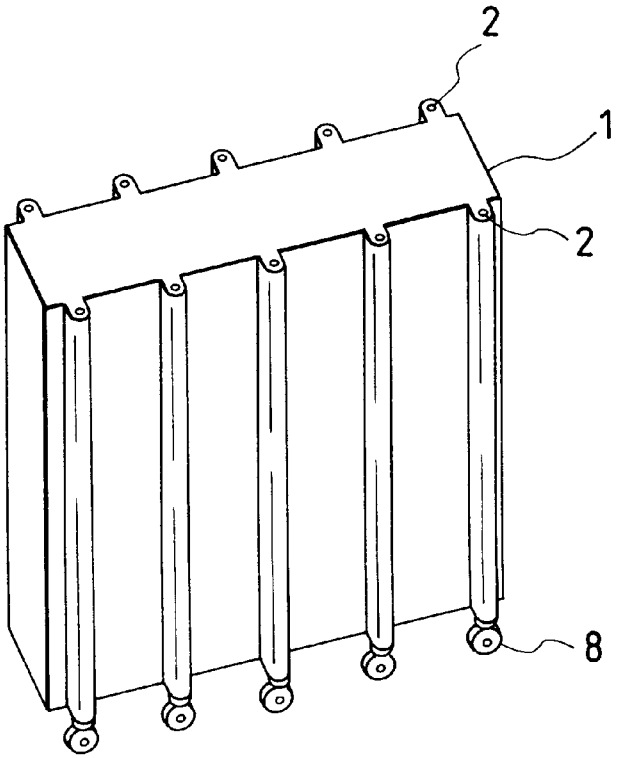
FIG. 10 is a perspective view showing wheels attached to the radiation shield of FIG. 1.
Figure 11:
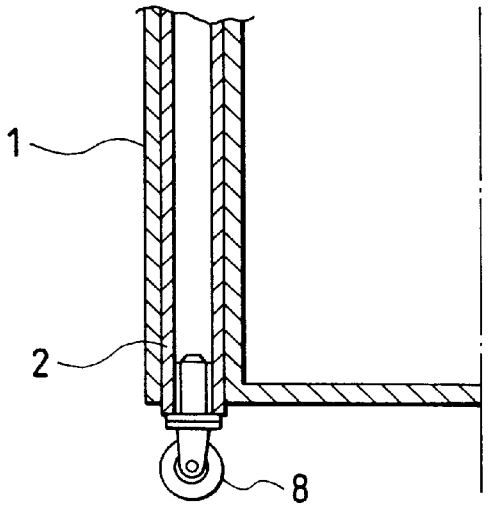
FIG. 11 is a longitudinal sectional view of the vicinity of the wheel attachment portion of FIG. 10.

In the structure shown in FIGS. 10 and 11, running means each having a wheel 8 are fitted to the bottom ends of the respective reinforcement pipes 2 of the radiation shield 1 so that the radiation shield 1 can readily be moved by the rolling of the wheels 8.

If this structure is adopted, the radiation shield 1 filled with water can readily be moved to and installed at a radiation shielding position, and can readily be moved away therefrom.

Figure 12:
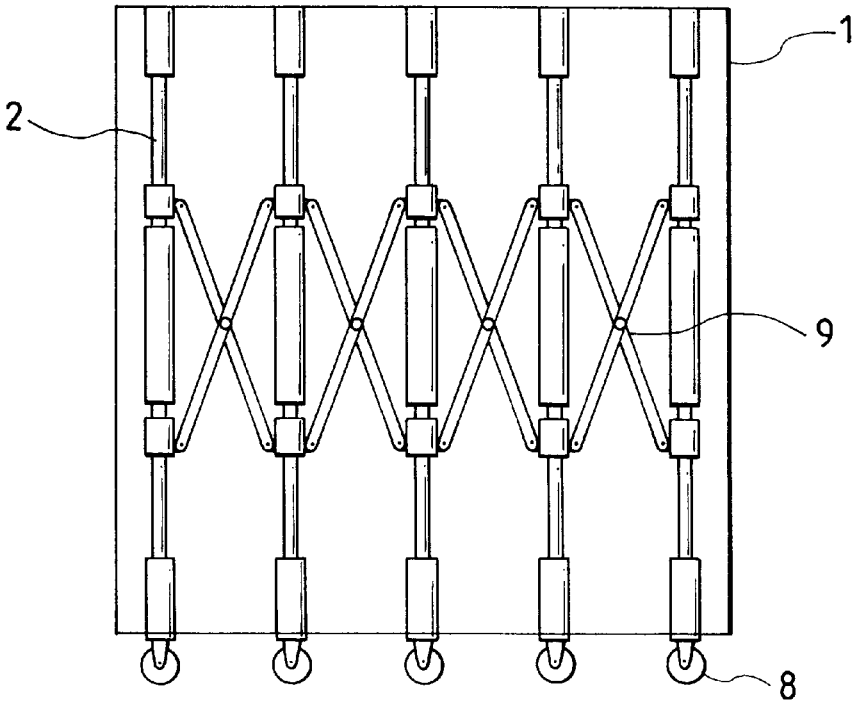
FIG. 12 is a perspective view showing a link mechanism attached to the radiation shield of FIG. 10.
Figure 13:
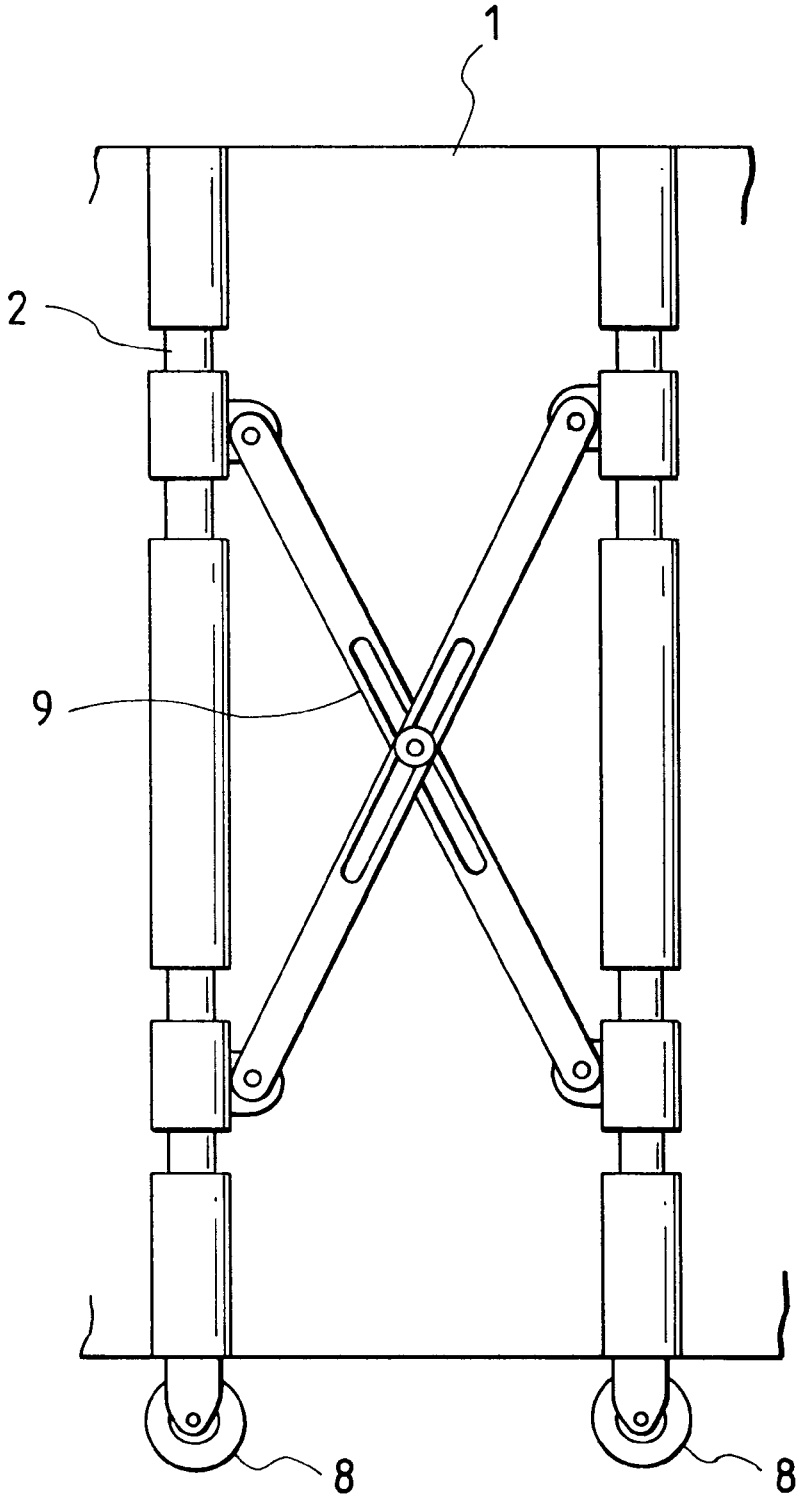
FIG. 13 is an enlarged view of the link mechanism portion of FIG. 12.

The structure shown in FIGS. 12 and 13 is provided with the wheels 8 similarly to the structure shown in FIGS. 10 and 11, but the following structure is added.

Specifically, two upper and lower portions of each of the longitudinal ribs are cut away and the pipe reinforcement 2 is partly exposed.

The exposed portions of each of the pipe reinforcements 2 are respectively provided with sliders 9*a* which are movable upward and downward, and links 9 which cross each other in an X-like form are vertically swingably fitted to adjacent ones of the sliders.

The crossing of the links 9 assembled in the X-like form is swingably fitted.

When such expandable link mechanism is expanded rightward and leftward, the radiation shield 1 can be rapidly unfolded to be set to a usable state. When the radiation shield 1 is to be put away, water is discharged from the radiation shield 1 and the link mechanism is shrank, whereby the radiation shield 1 can be rapidly folded into a compact shape suited to storage.

Since this example is also provided with the wheels 8, the handling and movement of the radiation shield 1 are easy.

Although each of the above-described embodiments adopts the reinforcement pipes 2 as reinforcement members, bars which are not pipe-shaped but solid may replace the reinforcement pipes 2 as reinforcement members.

In this case, each kind of connector is made from a hollow shaped member, and the relation between the fitting side and the fitted side is reversed.

The manner in which the wheels 8 are fitted is similarly reversed.

What is claimed is:

1. A radiation shield comprising:

a flexible bag, filled with a radiation shield liquid, for shielding from radiation;

rib-shaped portions extending in a vertical direction, said rib-shaped portions being integrally formed on said bag in such a manner as to project from a plurality of positions, spaced at intervals in a horizontal direction, of said bag; and reinforcement members extending in a vertical direction, said reinforcement members being provided in said rib-shaped portions in such a manner as to be integrated with said bag;

whereby said bag is able to self-stand in a vertical direction with the aid of said rib-shaped portions reinforced by said reinforcement members, and said bag is able to be folded at respective portions between said rib-shaped portions arranged at the plurality of positions of said bag.

2. A radiation shield according to claim 1, further comprising connectors for releasably connecting, to each other, said rib-shaped portions adjacent to each other of a plurality of said bags which are arranged adjacently to each other.

3. A radiation shield according to claim 1, further comprising connectors for connecting the plurality of said reinforcement members of said bag to each other, said connectors being removably attached to said reinforcement members.

4. A radiation shield according to claim 1, further comprising wheels mounted on said reinforcement members of said bag.

5. A radiation shield according to claim 1, further comprising expandable link mechanism for connecting said reinforcement members of said bag to each other.

* * * * *